US005461812A

United States Patent [19]

Bennett

[11] Patent Number: 5,461,812

[45] Date of Patent: Oct. 31, 1995

[54] METHOD AND APPARATUS FOR A WEAPON FIRING SAFETY SYSTEM

[76] Inventor: Emeric S. Bennett, 12149 Fowlers Mill Rd., Chardon, Ohio 44024

[21] Appl. No.: 340,529

[22] Filed: Nov. 16, 1994

[51] Int. Cl.[6] ..... F41A 17/06; F41A 17/46

[52] U.S. Cl. ..... 42/70.11; 42/70.06

[58] Field of Search ..... 42/70.06, 70.11

[56] References Cited

U.S. PATENT DOCUMENTS

| | | | |
|---|---|---|---|
| 4,003,152 | 1/1977 | Barker et al. | 42/70.11 |
| 4,067,132 | 1/1978 | Smith | 42/70.11 |
| 4,105,885 | 8/1978 | Orenstein | 42/70.06 |
| 4,154,014 | 5/1979 | Smith | 42/70.11 |
| 4,467,545 | 8/1984 | Shaw, Jr. | 42/70.11 |
| 4,488,370 | 12/1984 | Lemelson | 42/70.11 |
| 5,062,232 | 11/1991 | Eppler | 42/70.11 |
| 5,083,392 | 1/1992 | Bookstaber | 42/84 |
| 5,123,193 | 6/1992 | Pugh | 42/70.11 |
| 5,168,114 | 12/1992 | Enget | 42/70.06 |

*Primary Examiner*—Charles T. Jordan
*Assistant Examiner*—Theresa M. Wesson
*Attorney, Agent, or Firm*—Joseph H. Taddeo

[57] ABSTRACT

This invention teaches a novel method of safeguarding and protecting a weapon from being accidentally fired or misused by an unauthorized person. Without a verified preregistration signal, an arming safety solenoid remains in a fail-safe position, preventing use of the weapon. The electronically actuated solenoid enables the use of trigger only when a valid identification signal is received. The system is comprised of microminiature circuits contained within the grip of the weapon and a ring that is worn on same hand that uses the firearm.

When the weapon is first pickup by the intended user, a switch closure in the grip of the gun turns on a transmitter, which sends a low power, limited range interrogation signal to the finger ring. Upon receipt of this signal, a transponder mounted within the finger ring responds by sending a coded signal that contains a serial number identification. A microprocessor contained within the weapon then compares this decoded signal with one preregistered serial number stored in memory and if the comparison is valid, actuates the arming safety solenoid, allowing the gun to be fired.

Arming the weapon for firing can only be accomplished upon receipt of a verifiable identification signal from the finger ring; the finger ring must be worn by user and be within the range of the electromagnetic transceivers and must be within the range of the magnetic metal sensors.

16 Claims, 2 Drawing Sheets

METHOD AND APPARATUS FOR A WEAPON FIRING SAFETY SYSTEM

FIELD OF THE INVENTION

This invention relates to a gun safety system, and more particularly to a method and apparatus that prevents the discharge of a firearm by anyone other than an authorized pre-registered user.

BACKGROUND OF THE INVENTION

There is a particular need for preventing the accidental discharge of a weapon, such as a hand weapon, by an unauthorized person.

There are many problems that can occur with the use of weapons, automatic weapons and handguns. Guns are usually provided with a "safety," which is intended to prevent an accidental discharge by inhibiting the firing of the gun when the safety button or lever is switched on. The use of a "safety lever" does not help in preventing an unauthorized individual from using another person's gun.

One example of this type of problem is when a child finds a hidden gun in his home, where its unintentional use may cause serious injury or even the death of another child. Still another example of an accidental misuse of a weapon is where a criminal wrests a police officer's gun from him and uses it on him.

Measures to prevent the unauthorized use of a handgun include many procedures or devices, such as locking up the gun in a safe place, or by using devices like trigger locks or barrel plug locks to render the gun inoperative. While these measures prevent the unauthorized use of the gun, they also hinder the use of the gun by its rightful owner since it takes time to unlock and prepare the gun for use. These mechanisms would be useless to police officers, especially in a situation that was previously described.

It is an object of this invention to provide a new method and safety system that will prevent a gun from firing unless it is being held by the gun's owner. Any other unauthorized person who has not registered with the safety device will not be able to fire the weapon.

It is another object to provide a transponder means external to the weapon, such as a finger ring, as a means for exchanging data between the intended weapon and the registered user of the weapon having the finger worn ring.

Yet, another object of this invention is to provide a method of registration of a handgun with its accompanying finger ring that provides a verifiable identification code.

SUMMARY OF THE INVENTION

This invention relates to a method and apparatus that will prevent the accidental or willful firing of a weapon that was not previously authorized for use. The safety system features a finger ring that must be worn on the finger of the gun owner; associated circuitry built within the handgun capable of identifying the presence of a pre-registered ring; and a programming unit that will register the user wearing the ring with the correct handgun.

In typical use, the authorized user wears the finger ring on the same hand that is used for firing the weapon. Mounted within the stock of the gun is an arming safety mechanism that prevents the firing of the gun. When the safety lever of the gun is moved to an on position, a short range interrogation signal is transmitted from the weapon. This short range signal is normally received by a miniaturized transponder contained within the finger ring worn by the user. The transponder, upon receipt of the interrogation signal, responds by transmitting a coded verification serial number. This coded verification serial number is received by a miniaturized receiver contained within the grip of the weapon. A microprocessor then compares the received serial number to one that was previously stored in memory, and if there is a valid comparison, the arming safety mechanism is removed, enabling the weapon to be armed and fired.

An enabling procedure must be followed whenever the ring is placed on the finger of the person designated to operate the gun. This procedure is normally performed after the ring is placed on the finger and the gun is held in a normal manner. The programming unit then sends a signal to both the microprocessor in the gun and the transponder in the ring, which causes the microprocessor in the gun to recognize that particular ring as one worn by the person designated to operate that gun. The gun-ring pair will now operate together until the ring is removed from the finger. Once the registration is complete, the programming unit is stored in a secure location until needed again to register or change the identification serial number.

DESCRIPTION OF THE PREFERRED EMBODIMENT

Figure 1:
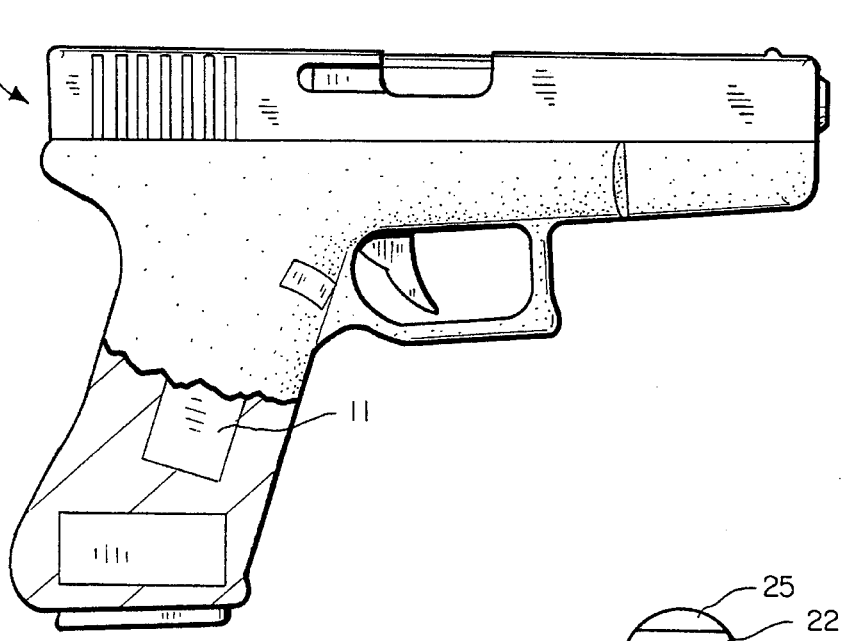
FIG. 1 is a side elevational view of a handgun with a portion of the stock broken away to show the components of the invention.

Shown in FIG. 1 are the components of a hand held gun 10 that electronically enables its operation for its intended use. The normal safety interlock of the gun is no longer controlled by the person holding the gun, but rather by a filter means or microcomputer 11. The gun would only be permitted to fire when the microcomputer was switched on (an operation similar to the old function of the gun safety lever) and when the microcomputer determined that a previously designated person was holding the gun.

The microcomputer 11 can determine if a designated person is holding the gun by transmitting a signal to the ring on the finger of the person holding the gun. The transponder in the ring then sends a message back to the microcomputer in the gun with its identifying number encoded in the message. The microcomputer 11 in the gun then verifies that the correct identifying number has been received, then releases the safety mechanism of the gun, allowing it to be fired. This process is repeated several times a second. If there is no response or if an incorrect response is received by the microcomputer in the gun, it would not release the safety interlock of the gun, thereby preventing firing of the gun. The safety means or mechanism of the gun is normally in a disarmed position and only moves to an armed position upon receipt of an appropriate signal from the microcomputer.

Figure 2:
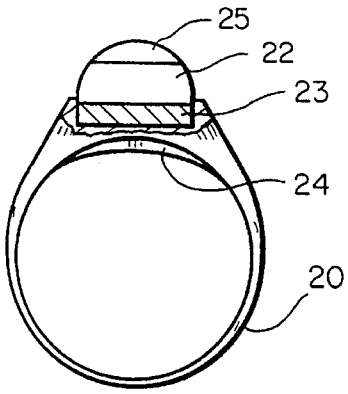
FIG. 2 is a side view of a finger ring to be worn by the intended user to enable the operation of the handgun when worn in close proximity, as when the weapon is held in the same hand.
Figure 6:
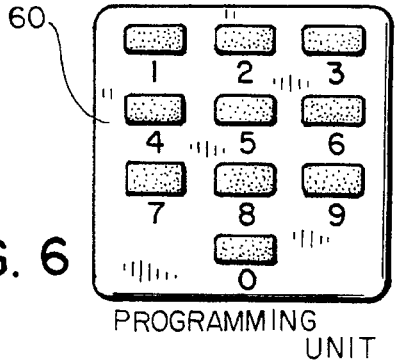
FIG. 6 is a top elevation of the programming unit.

In FIG. 2 is an element external to the weapon indicated as finger ring 20 that shows the electronic system. The electronic system contained in the ring consists of a transponder 22, a switch mechanism 24, a magnetic metal detector 25, and wrist watch styled batteries 23.

Transponder 22 is a device that includes a receiving component, a transmitting component and an automatic controlling component that controls the actuation over the other two components. An example of a transponder can be found and its use can be found on airplanes. Many airplanes have a transponder that is used by air traffic controllers on the ground to keep track of the location of the planes shown on their radar screens. When the ground radar directs a radio pulse towards an airplane, the transponder on that airplane receives the pulse and automatically transmits an answering radio pulse with the identifying number of the airplane encoded in the pulse. The ground radar system receives this pulse, and the computer that controls the radar display decodes the identifying number of the airplane and prints it on the radar screen next to the blip caused by that airplane. The air traffic controller viewing the radar screen can more easily identify all airplanes since their identifying numbers are associated with their blips. Recent advances in microelectronics make it possible to build a transponder into an integrated circuit that may be as small as a few tenths of an inch square. These transponders operate from small wristwatch batteries as illustrated in 23. Switch mechanism 24 disconnects the power source from the transponder when the ring is removed from one's finger.

Figure 3:
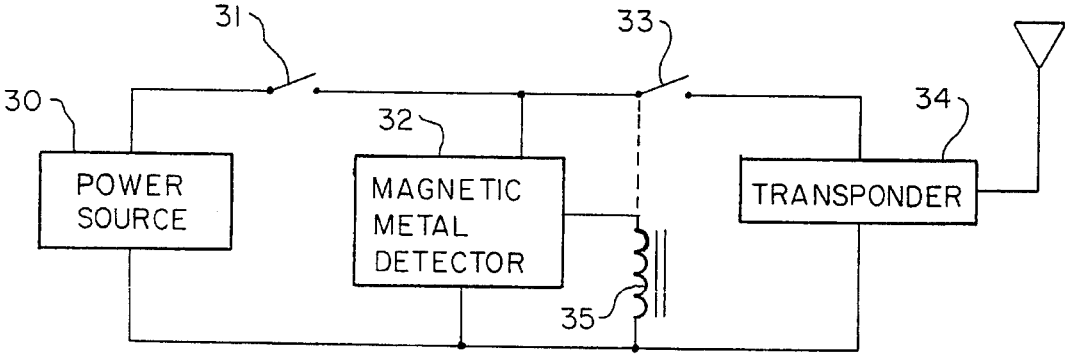
FIG. 3 is a schematic diagram of the finger ring as worn by the intended user.

Referring now to FIG. 3, the ring 20 has several features that prevent misuse of the ring when used with the system. A switch mechanism 31 detects whether the ring is mounted on the user's finger, by providing a switch closure. Once the ring is removed from the finger, the transponder 34 reverts to an inactive state because of switch mechanism 31 is in an open state, thereby removing the source of power 30 from the transponder 34. Removal of the element or finger ring 20 also erases the enabling code stored in the element or ring, for data stored within the element is lost upon removal of its power. Stated otherwise, removal of the ring breaks the standard memory circuit of the transponder with resultant loss of the enabling code stored therein. With switch mechanism 31 in an open state, the transponder 34 will no longer respond to any messages sent from the microprocessor in the gun. Once this happens, the gun can no longer be fired.

It should be understood then that if a gun is taken from a police officer, removal of the ring by the officer would prevent use of the gun by the assailant.

As an additional safeguard a magnetic detector 32, such as a Hall effect device, senses the presence of a gun. If the magnetic field intensity emanating from the metal gun is not of sufficient strength because it is not within the range that is typical of a hand holding the gun, relay or solid state switch 35 will become de-energized at contact 33 disabling the transponder, thereby preventing response to the transmitted signal from the gun. A further advantage of the magnetic detector 32 is that it may be used to turn off the power to all circuits in the ring except for the magnetic metal detector itself, when no gun is present.

It should be further understood then that if a gun is taken from a police officer and carried any distance from the element worn by the officer, relay or solid state switch 35 de-energizes the transponder which prevents use of the gun by the assailant.

Figure 4:
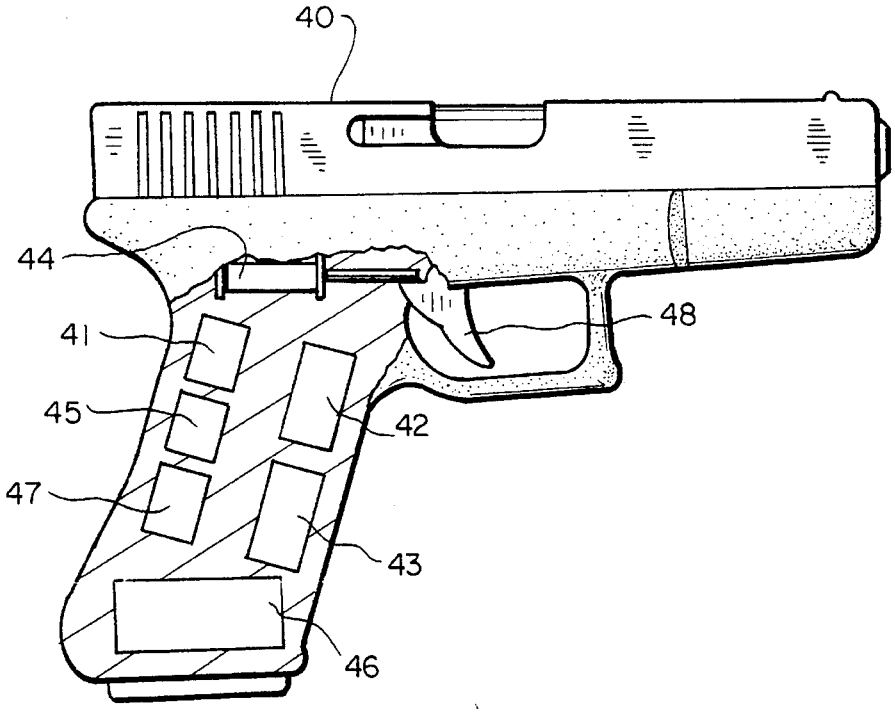
FIG. 4 is a cutaway view of the handle portion of a handgun showing the components incorporated in this invention.

Turning now to FIG. 4, safety lever 47 is normally in an open state, which disconnects all circuits from the power source 46, rendering them inoperative while conserving battery energy. Without power, arming an electromechanical actuator or safety solenoid 44 effectively blocks movement of the trigger mechanism 48, thereby preventing the gun 40 from being fired.

A miniaturized low power transmitter 45 provides a restricted range of operation. If the signal from the transmitter is of a signal strength that indicates that the gun is more than several inches away from the finger ring 20, the transponder 22 located within the ring will not respond to the transmitted signal. If the gun is within the preferred distance from the ring, the transponder 22 responds with an appropriate signal that contains its identification number. This signal is then received by receiver 41, subsequently decoded by decoder 42 and then passed on to the microprocessor 43. Microprocessor 43 compares this decoded signal with a previously stored identification number stored in memory. A valid comparison will result in energizing arming the electromechanical actuator, which may be a safety solenoid 44 or a piezoelectric device, thereby allowing the trigger 48 of the gun to be depressed.

Figure 5:
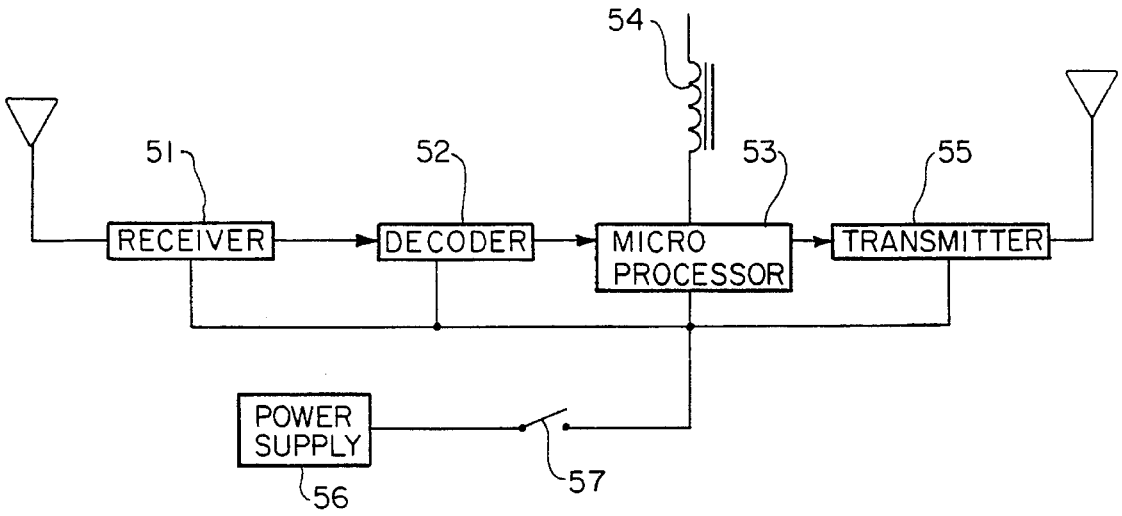
FIG. 5 is a schematic diagram of the circuitry of the components contained within the handle portion of the gun.

In FIG. 5, the schematic diagram of the components of the grip, show the safety lever 57 connected intermediate to the power source 56. When the safety lever is in the off position, all power to the internal circuits is disabled. By manual movement of the safety lever 57 power is applied to the transmitter 55, the receiver 51, the decoder 52 and the microprocessor 53. By applying power to transmitter 55, an interrogation signal is sent to the transponder found in the finger ring. The transponder responds by sending an identification serial number to receiver 51, which decodes it and passes it to the microprocessor 53. A valid comparison energizes arming safety solenoid 54, thereby permitting the use of the weapon.

The programming unit 60 is preferably a numbered keypay which allows the registration of a valid operator for the gun-ring pair, and resembles the portable keypad used in a handheld calculator or a TV remote. The enabling procedure must proceed whenever the ring is placed on the finger of the person designated to operate the weapon following every occasion of its removal.

In the preferred embodiment, the programming keypad unit sends a message to both the microprocessor in the gun and to the transponder in the ring, which causes the microprocessor to compare and recognize that particular ring as the one worn by the designated person to operate the gun. The external element or ring 20 is also enabled to respond to the interrogating signal from the weapon or gun. Once the unit is programmed, the programming unit is then stored in a secure location until needed again.

Although the weapon firing safety system disclosed herein indicates applicability for use with a handgun, this apparatus also has application for use with other types of guns and weapons, such as a rifles, rapid firing assault weapons, and even in tanks, fighter aircraft and missile launching platforms. Furthermore, the safety system of this invention could be applied to presses, lathes and other manufacturing machinery to enhance safety of operators thereof.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular suggestion or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. A safety apparatus for a weapon to prevent firing of the weapon by an unauthorized user, comprising:

a weapon having a weapon circuit, a filter means and a safety means in communication with the filter means, the safety means having a normally disarmed position and an armed position; and[,If the safety means adapted for moving from the normally disarmed position to said armed position upon a signal from the filter means;

an element adapted to be worn by a user of the weapon, the element having a circuit, a first means for energizing the element circuit when the element is worn by a user of the weapon and a second means for energizing the element circuit concomitant with proximity of the element to the weapon;

a first communication means in the weapon adapted to elicit a response from the element;

a second communication means associated with the element, the second communication means comprising a transponder adapted to receive a signal from the weapon; and; to generate a transponder signal back to the weapon;

a programming means for coding an identification number in the transponder and the filter means;

said filter means having a recognition means responsive to the coded identification number in the transponder signal, and a means for generating an output signal to said safety means for release of the safety means to the armed position.

2. A safety apparatus according to claim 1, wherein the safety means is a solenoid.

3. A safety apparatus according to claim 1, wherein the safety means is a piezoelectric device.

4. A safety apparatus according to claim 1, wherein the transponder is energized by the signal from the first communication means of the weapon.

5. A safety apparatus for a weapon to prevent firing of the weapon by an unauthorized user, comprising:

a weapon having a circuit with a weapon power supply and a weapon power switch; a safety means with a normally disarmed position and an armed position; a signal means; a receiver means; and a microprocessor associated with the weapon;

an element adapted to be worn by an authorized user, said element having an element circuit with an element power source, an element power switch, a transponder comprising a receiving means to input a signal and transmitting means to output a signal, and a controlling means for controlling actuation of the receiving means and the transmitting means;

a programming means to encode an identification number in the transmitting means of the element and the weapon microprocessor;

said microprocessor having as an input the signal from the element, a recognition means responsive to the coded identification number, and a means for generating an output signal to said safety means for release of the safety means to the armed position.

6. A safety apparatus for a weapon as described in claim 5, wherein the controlling means of the element comprises a magnetic detector adapted for sensing a magnetic intensity, the detector having a detector switch adapted for closure to complete the element circuit by the magnetic intensity from said detector and the detector switch.

7. A safety apparatus for a weapon as described in claim 6, wherein the element comprises a finger ring.

8. A safety apparatus for a weapon as described in claim 7, wherein the element power switch is closed and the element circuit is connected to its power source by mounting the ring on the user's finger and the element power switch is opened when the ring is removed from the user's finger.

9. A safety apparatus for a weapon as described in claim 6, wherein the element comprises a bracelet.

10. A safety apparatus for a weapon as described in claim 9, wherein the element power switch is closed and the element circuit is connected to its power source by mounting the bracelet on the wrist of the user and the element power switch is opened when the bracelet is removed from the user's wrist.

11. A safety apparatus for a weapon as described in claim 6, wherein the element comprises a clothing decoration having a closure pin.

12. A safety apparatus for a weapon as described in claim 11, wherein the power switch of the element is closed and the element circuit is connected to its power source by closing the pin of the clothing decoration.

13. A safety apparatus for a weapon as described in claim 6, wherein the weapon further comprises a firing mechanism; and, safety means of the weapon comprises an electromechanical actuator having a normally disarmed position and adapted to block movement of the firing mechanism of the weapon and to prevent the weapon from being fired when in the disarmed position and allowing the weapon to be fired in the armed position.

14. A safety apparatus for a weapon as described in claim 13, wherein the magnetic detector of the element comprises a Hall effect device.

15. A safety apparatus for a weapon as described in claim 14, wherein the weapon further comprises a decoder intermediate to the weapon receiver and microprocessor, the decoder adapted to decode signals from the element and pass the signals on to the microprocessor.

16. A method for use of a safety apparatus for a weapon to prevent firing of the weapon by an unauthorized user, comprising:

providing a weapon having a safety apparatus to prevent firing of the weapon by an unauthorized user, comprising:

a weapon having a power source, a weapon circuit, a filter means and a safety means in communication with the filter means, the safety means comprising a grip switch, the grip switch having a normally disarmed position and an armed position; and; the safety means adapted for moving from the normally disarmed position to said armed position upon a signal from the filter means;

an element adapted to be worn by a user of the weapon, the element having a magnetic metal detector and a detector switch, a circuit, a first means for energizing the element circuit, said first means comprising an element power switch having open and closed positions and adapted for closure of the switch when the element is worn by a user of the weapon; and; a second means for energizing the element circuit concomitant with proximity of the element to the weapon;

a first communication means in the weapon adapted to elicit a response from the element;

a second communication means associated with the element, the second communication means comprising a transponder adapted to receive a signal from the weapon and to generate a transponder signal back to the weapon;

a programming means for coding an identification number in the transponder and the filter means;

said filter means having a recognition means responsive to the coded identification number in the transponder signal, and a means for generating an output signal to said safety means for release of the safety means to the armed position;

mounting the ring element on the finger of a user to close the element power switch;

positioning the weapon grip switch to the armed position by the user to close the weapon circuit for connection of said circuit to its power source;

encoding an identification number in the element transponder and the filter with the programming means;

sensing the magnetic intensity by the magnetic metal detector when the weapon is proximate to the element;

closing the switch of the magnetic metal detector to enable the transponder;

transmitting a signal from the weapon to the element;

responding to the transmitted weapon signal by the element transponder with an appropriate signal that contains the encoded identification number;

decoding the signal from the transponder by the decoder and passing the decoded signal to the microprocessor;

comparing the decoded signal with the encoded identification number in the filter means; and if a valid comparison;

generating a signal from the filter means to the safety means;

release of the safety means to the armed position; and;

firing the weapon.

* * * * *